US008006409B2

(12) United States Patent
Chen et al.

(10) Patent No.: US 8,006,409 B2
(45) **Date of Patent: *Aug. 30, 2011**

(54) SPIKE ASSEMBLY FOR SPORT SHOES

(76) Inventors: Kuming Chen, Tanzih Township, Taichung County (TW); Hsien Ping Chen, Tanzih Township, Taichung County (TW)

( * ) Notice: Subject to any disclaimer, the term of this patent is extended or adjusted under 35 U.S.C. 154(b) by 836 days.

This patent is subject to a terminal disclaimer.

(21) Appl. No.: 12/034,704

(22) Filed: Feb. 21, 2008

(65) Prior Publication Data

US 2009/0211117 A1 Aug. 27, 2009

(51) Int. Cl.
*A43B 5/00* (2006.01)

(52) U.S. Cl. ..... 36/67 D; 36/134

(58) Field of Classification Search ..... 36/134, 36/67 D, 67 R; D2/962

See application file for complete search history.

(56) References Cited

U.S. PATENT DOCUMENTS 5,123,184 A * 6/1992 Ferreira ..... 361/34
5,321,901 A * 6/1994 Kelly ..... 36/134
5,524,367 A * 6/1996 Ferreira et al. ..... 36/134
5,974,700 A * 11/1999 Kelly ..... 36/134
6,233,850 B1 * 5/2001 Peabody ..... 36/134
6,708,428 B2 * 3/2004 Chen ..... 36/134
6,810,608 B2 * 11/2004 Kelly ..... 36/134
6,834,445 B2 * 12/2004 McMullin ..... 36/127
7,007,413 B2 * 3/2006 McMullin ..... 36/134
7,137,213 B2 * 11/2006 Kelly et al. ..... 36/134
2002/0152643 A1 * 10/2002 Kim ..... 36/127
2008/0196276 A1 * 8/2008 McMullin ..... 36/127
2009/0211116 A1 * 8/2009 Chen et al. ..... 36/134

* cited by examiner

*Primary Examiner* — Jila M Mohandesi

(57) ABSTRACT

A spike assembly for sport shoes includes a base with a tubular portion. A plurality of protrusions extends from the base portion in an axial direction of the base portion. Each protrusion includes an inclined side and a vertical side with a rounded portion connecting between the inclined side and the vertical side. A spike member includes a screw portion which is securely connected to the tubular portion, and a plurality of blocks extends from the spike member. Each block includes a curved protrusion facing the screw portion. The screw portion is connected to the tubular portion, and the curved protrusions are guided along the inclined sides of the protrusions and then, are stopped by the vertical sides of the protrusions. The spike member does not become loose by the weight of the wearer.

1 Claim, 7 Drawing Sheets

SPIKE ASSEMBLY FOR SPORT SHOES

FIELD OF THE INVENTION

The present invention relates to a spike assembly for sport shoes having a spike member which is easily and securely connected to the base.

BACKGROUND OF THE INVENTION

Conventional sport shoes, such as golf shoes, soccer shoes or baseball shoes, require good grasp to the ground. Thus, spikes extend from an underside of the outsole, and the spikes cut into the ground to provide a reliable grasp. A conventional spike assembly is shown in FIGS. 5 to 7 and generally includes a base 32 which is embedded in a recess defined in the underside of the outsole 20 of the shoe, and a spike member 33 is connected to the base 32. The base 32 includes a disk 321 with a tubular portion 322 extending from a center thereof, and a spiral groove 323 is defined in an inner periphery of the tubular portion 322. A plurality of protrusions 324 extends radially from the outer periphery of the tubular portion 322. The spike member 33 includes a disk 331, and a screw portion 332 extends from a center of the first side of the disk 331. A plurality of blocks 333 extends from the disk 33 and is located around the screw portion 332. Each block 333 includes a curved protrusion 334 extending therefrom which faces the screw portion 332. Spikes 335 extend from the second side of the disk 332.

When screwing the screw portion 332 with the spiral groove 323 of the tubular portion 322, the curved protrusions 334 are stopped by the protrusions 324 on the base 32. Thus, the user has to use a tool to rotate the spike member 33 to press the protrusions 324 to allow the curved protrusions 334 to be engaged with the recesses between the protrusions 324. The curved protrusions 334 are engaged with the recesses between the protrusions 324 in a radial direction. When the wearer wears the shoes, a load is applied to the spike assembly, the blocks 333 are pushed outward in the radial direction, and the curved protrusions 334 may be guided by the slope of the recesses between the protrusions 324. Thus, the spike member 33 can be loosened from the base 32.

The present invention provides a spike assembly for sport shoes having a spike member securely connected to the base in an axial direction so that the wearer's weight does not affect the connection between the spike member and the base.

SUMMARY OF THE INVENTION

The present invention relates to a spike assembly for sport shoes, with the spike assembly including a base and a spike member. The base includes a first disk, and a tubular portion extends from a center of a first side of the first disk. A spiral groove is defined in an inner periphery of the tubular portion. A plurality of protrusions extends axially from the first side of the first disk and is connected to an outer periphery of the tubular portion. Each protrusion is a substantially triangular protrusion and includes an inclined side relative to the first side of the first disk and a vertical side perpendicular to the first side of the first disk. A rounded portion connects the inclined side and the vertical side. The spike member includes a second disk, and a screw portion extends from a center of a first side of the disk. A plurality of blocks extends from the first side of the second disk and is located around the screw portion. Each block includes a curved protrusion extending therefrom which faces the screw portion. A plurality of spikes extends from a second side of the second disk.

The screw portion is engaged with the spiral groove in the tubular portion, and the curved protrusions slide along the inclined sides of the protrusions, move over the rounded portions and are stopped by the vertical sides.

The primary object of the present invention is to provide a spike assembly for sport shoes having a spike member securely connected to the base by engaging the curved protrusions on the spike member with the vertical sides of the protrusions on the base in an axial direction, even if the blocks are moved outward in a radial direction when the wearer's weight is applied to the spike assembly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
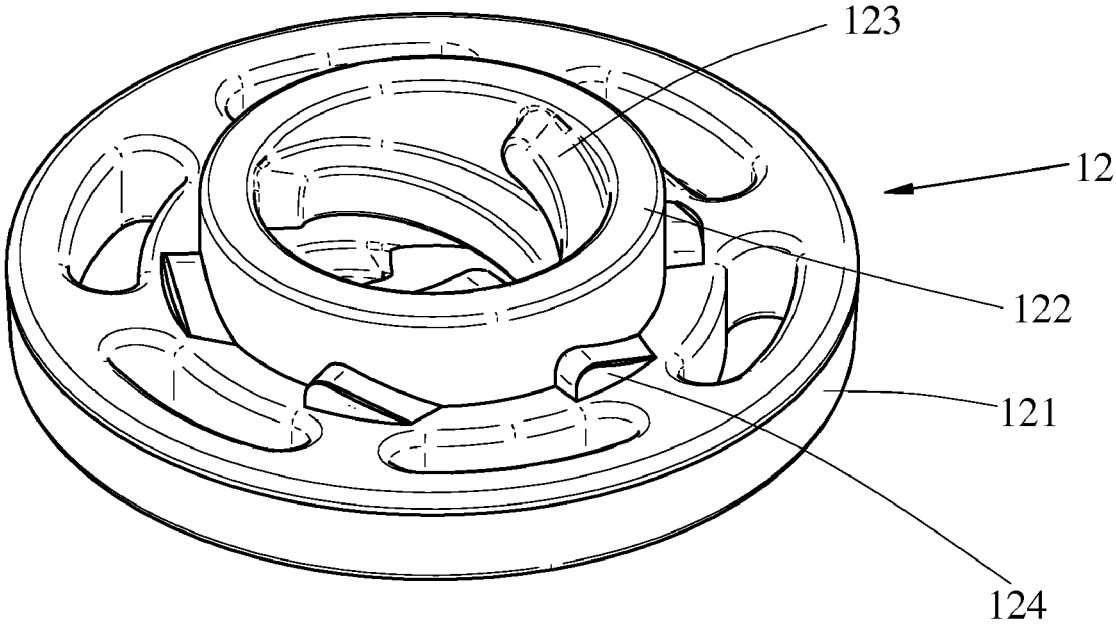
FIG. 1 is a perspective view showing the base of the spike assembly of the present invention.
Figure 2:
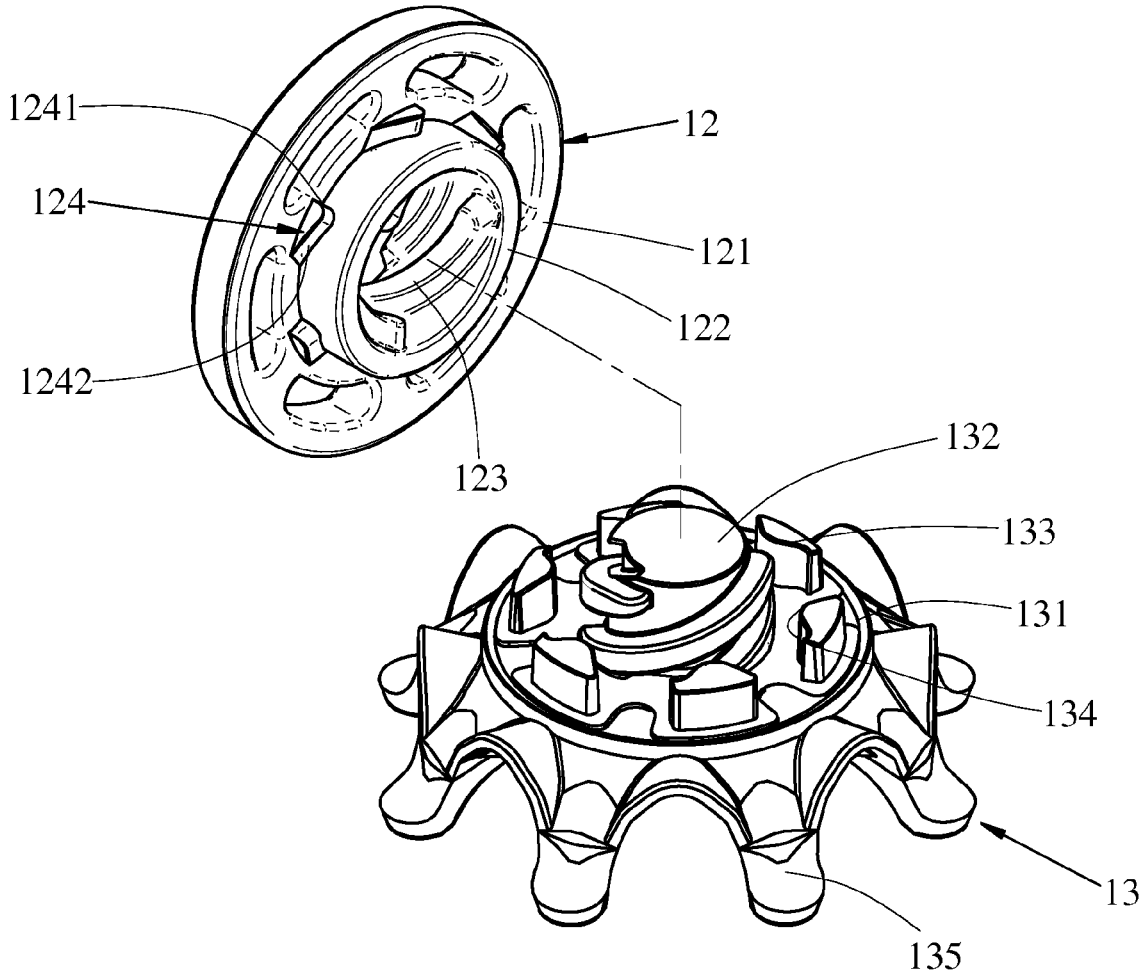
FIG. 2 is an exploded view showing the spike assembly of the present invention.
Figure 3:
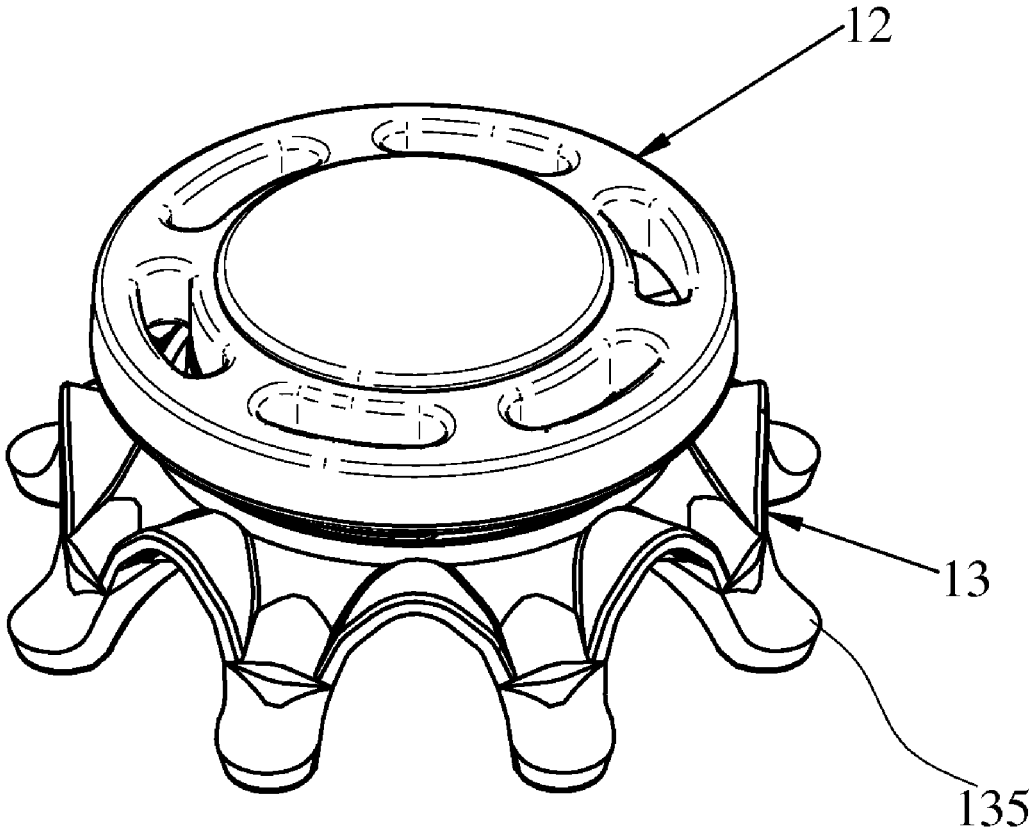
FIG. 3 is a perspective view showing the spike assembly of the present invention.

Referring to FIGS. 1 to 3, the spike assembly for sport shoes of the present invention comprises a base 12 which includes a first disk 121. A tubular portion 122 extends from a center of a first side of the first disk 121. A spiral groove 123 is defined in an inner periphery of the tubular portion 122. A plurality of protrusions 124 extends axially from the first side of the first disk 121 and is connected to an outer periphery of the tubular portion 122. Each protrusion 124 is a substantially triangular protrusion and includes an inclined side 1242 relative to the first side of the first disk 121 and a vertical side 1241 perpendicular to the first side of the first disk 121. A rounded portion connects between the inclined side 1242 and the vertical side 1241.

A spike member 13 includes a second disk 131, and a screw portion 132 extends from a center of a first side of the disk 131. A plurality of blocks 133 extend from the first side of the second disk 13 and is located around the screw portion 132. Each block 133 includes a curved protrusion 134 extending therefrom which faces the screw portion 132. A plurality of spikes 135 extends from a second side of the second disk 131.

Figure 4:
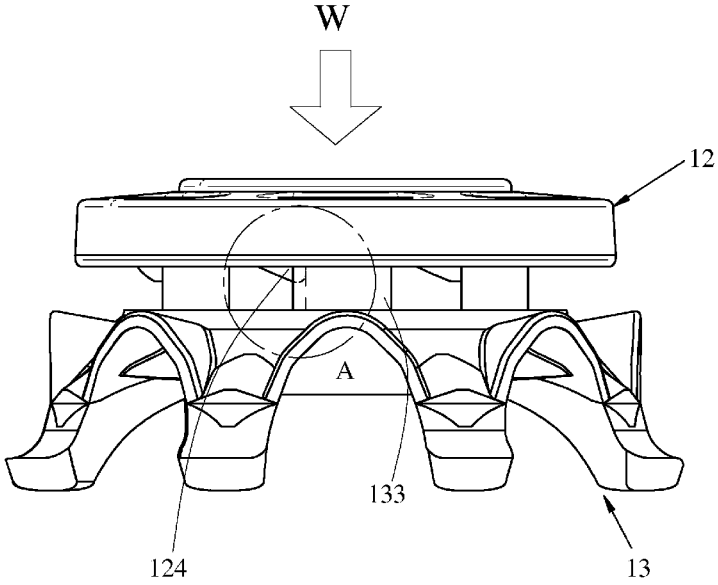
FIG. 4 shows a weight applied to the spike assembly of the present invention.
Figure 4A:
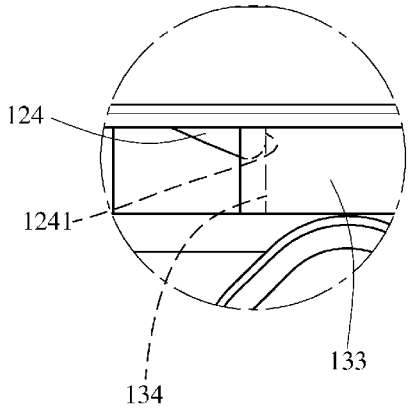
FIG. 4A is an enlarged view showing the engagement of the curved protrusion of the spike member and the vertical side of the protrusion on the base.
Figure 5:
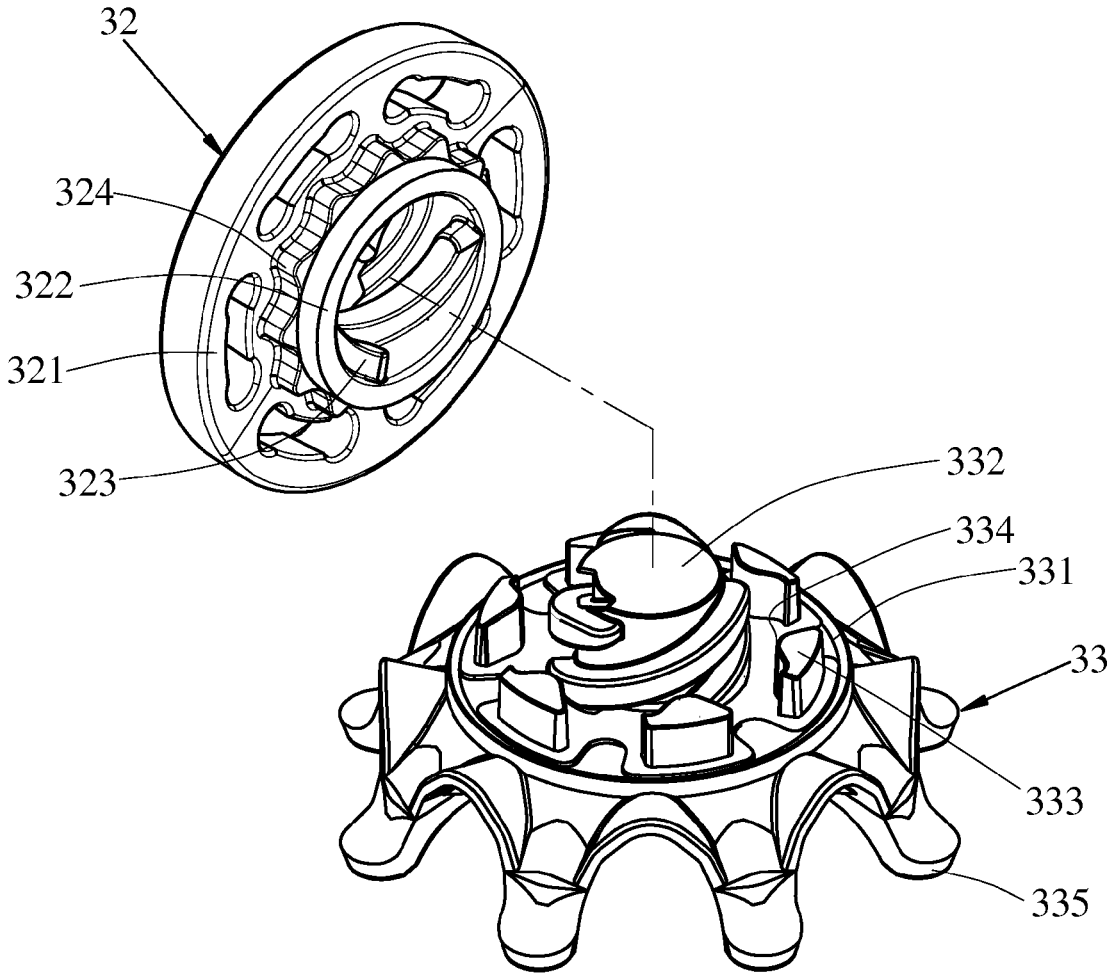
FIG. 5 PRIOR ART
FIG. 5 is an exploded view showing the conventional spike assembly.
Figure 6:
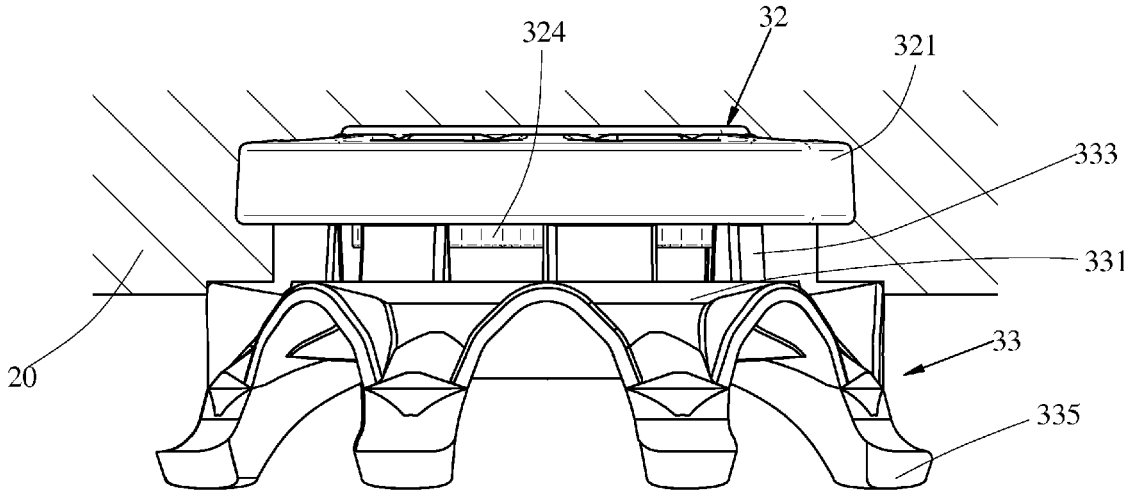
FIG. 6 PRIOR ART
FIG. 6 is side view showing the conventional spike assembly connected to the outsole of the sport shoe.
Figure 7:
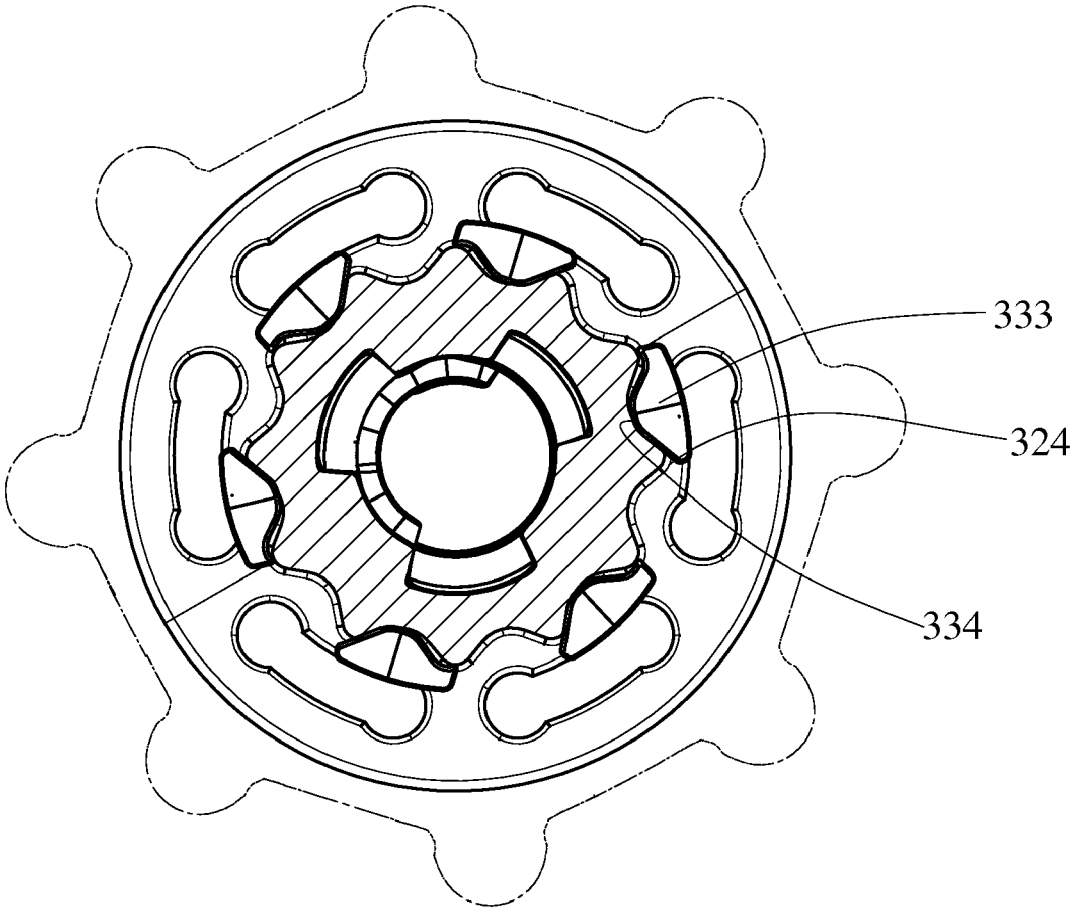
FIG. 7 PRIOR ART
FIG. 7 is a partial cross sectional view showing the engagement of the curved protrusion of the conventional spike member and the recess of the conventional base.

Referring to FIGS. 4 and 4A, the screw portion 132 is engaged with the spiral groove 123 in the tubular portion 122 by rotating the spike member 13. The curved protrusions 134 slide along the inclined sides 1242 of the protrusions 124, move over the rounded portions, and are stopped by the vertical sides 1241.

The curved protrusions 134 of the blocks 133 are stopped by the vertical sides 1241 of the protrusions 124 so that the curved protrusions 134 cannot slide the vertical sides 1241 when the wearer applies weight to the spike member 13.

While the embodiment in accordance with the present invention has been shown and described, it should be clear to those skilled in the art that further embodiments may be made without departing from the scope of the present invention.

What is claimed is:

1. A spike assembly for sport shoes, comprising:

a base including a first disk and a tubular portion extending from a center of a first side of the first disk, with a spiral groove defined in an inner periphery of the tubular portion, with a plurality of protrusions extending axially from the first side of the first disk and connected to an outer periphery of the tubular portion, with each protrusion being a substantially triangular protrusion and including an inclined side relative to the first side of the first disk and a vertical side perpendicular to the first side of the first disk, with a rounded portion connecting between the inclined side and the vertical side, and a spike member including a second disk and a screw portion extending from a center of a first side of the disk, with a plurality of blocks extending from the first side of the second disk and located around the screw portion, with each block including a curved protrusion extending therefrom which faces the screw portion, with a plurality of spikes extending from a second side of the second disk, with the screw portion engaged with the spiral groove in the tubular portion, and with the curved protrusions sliding along the inclined sides of the protrusions, moving over the rounded portions, and being stopped by the vertical sides.

* * * * *